US006276775B1

(12) United States Patent
Schulte

(10) Patent No.: US 6,276,775 B1
(45) Date of Patent: Aug. 21, 2001

(54) VARIABLE DROP MASS INKJET DROP GENERATOR

(75) Inventor: Donald W. Schulte, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/302,176

(22) Filed: Apr. 29, 1999

(51) Int. Cl.[7] ..... B41J 2/205; B41J 2/05
(52) U.S. Cl. ..... 347/15; 347/62
(58) Field of Search ..... 347/15, 48, 56, 347/61, 63, 62

(56) References Cited

U.S. PATENT DOCUMENTS

| | | | | |
|---|---|---|---|---|
| 4,339,762 | * | 7/1982 | Shirato et al. | 347/62 |
| 4,514,741 | | 4/1985 | Meyer | 347/62 |
| 4,870,433 | * | 9/1989 | Campbell et al. | 347/62 |
| 4,894,664 | | 1/1990 | Pan | 347/63 |
| 4,935,752 | | 6/1990 | Hawkins | 347/62 |
| 5,428,376 | | 6/1995 | Wade et al. | 347/14 |
| 5,477,243 | | 12/1995 | Tamura | 347/12 |
| 5,808,640 | | 9/1998 | Bhaskar et al. | 347/58 |
| 5,835,112 | | 11/1998 | Whitlock et al. | 347/50 |

FOREIGN PATENT DOCUMENTS

| | | | |
|---|---|---|---|
| 0124312A2 | 4/1984 | (EP) | B41J/3/04 |
| 0855277 | 1/1998 | (EP) | B41J/2/205 |
| 1-188347 | 1/1988 | (JP) | B41J/3/04 |
| 1-99860 | 10/1997 | (JP) | B41J/3/20 |

* cited by examiner

*Primary Examiner*—John Barlow
*Assistant Examiner*—Juanita Stephens
(74) *Attorney, Agent, or Firm*—Raymond A. Jenski

(57) ABSTRACT

An inkjet printing device employs an inkjet printhead with a plurality of drop generators to eject drops of ink. Each drop generator includes a planar heater resistor, comprising three segments. Two of the segments are disposed on either side of the third segment and provide a reduced thermal loss for the third segment. This reduced thermal loss and other features cause a controlled nucleation point to occur over the third segment even though the two segments on either side will create ink vapor bubbles of variable size depending upon the applied energy.

14 Claims, 7 Drawing Sheets

VARIABLE DROP MASS INKJET DROP GENERATOR

BACKGROUND OF THE INVENTION

The present invention relates generally to methods and apparatus for reproducing images and alphanumeric characters, and more particularly to a thermal inkjet drop generator, printhead construction, and the respective method of operation.

The art of inkjet printing technology is relatively well developed. Commercial products such as computer printers, graphics plotters, copiers, and facsimile machines employ inkjet technology for producing hard copy printed output. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices are also described by W. J. Lloyd and H. T. Taub in Output Hardcopy Devices, chapter 13 (Ed. R. C. Durbeck and S. SherT, Academic Press, San Diego, 1988).

A thermal inkjet printer for inkjet printing typically includes one or more translationally reciprocating print cartridges in which small drops of ink are formed and ejected towards a medium upon which it is desired to place alphanumeric characters, graphics, or images. Such cartridges include a printhead having an orifice member or plate that has a plurality of small nozzles through which the ink drops are ejected. Adjacent to the nozzles are ink firing chambers, in which ink resides prior to ejection through the nozzle. Ink is supplied to the ink-firing chambers through ink channels that are in fluid communication with an ink supply, which may be contained in a reservoir portion of the print cartridge or in a separate ink container spaced apart from the printhead.

Ejection of an ink drop through a nozzle employed in a thermal inkjet printer is accomplished by quickly heating a volume of ink within the adjacent ink firing chamber with a selectively energizing electrical pulse to a heater resistor positioned in the ink firing chamber. At the commencement of the heat energy output from the heater resistor, bubble nucleation generally commences at locations of dissimilarities in the ink liquid or at defect sites on the surface of the heater resistor or other interface surfaces (heterogeneous nucleation). It is well known that heterogeneous nucleation of an ink vapor bubble is favored to occur energetically at interfaces. Although it is possible to promote homogeneous nucleation, it is not possible to do so in the absence of heterogeneous nucleation occurring at the interface between the ink and the contact surface where heat transfer occurs. If the location of these nucleation sites is not optimized, bubble formation will occur randomly or at various uncontrolled sites within the ink firing chamber. Therefore, although one may wish to drive the process to homogeneous nucleation on the heating surface of the structure, it is heterogeneous nucleation which occurs due to its reduced energy requirement at the high energy interface. The rapid expansion of the ink vapor bubble forces ink through the nozzle. Once ink is ejected, the ink-firing chamber is refilled with ink from the ink channel and ink supply.

The energy required to eject a drop of a given volume is referred to as "turn on energy". The turn-on energy is a sufficient amount of energy to form a vapor bubble having sufficient size to eject a predetermined amount of ink through the printhead nozzle. Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses and ink crashes into the ink firing chamber components between firing intervals. The heater resistor is particularly susceptible to damage from cavitation. A thin hard protective passivation layer is typically applied over the resistor and adjacent structures to protect the resistor from cavitation. The passivation layer, however, tends to increase the turn-on energy required for ejecting droplets of a given size. Another layer is typically placed between the cavitation layer and the heater resistor and associated structures. Thermal inkjet ink is chemically reactive, and prolonged exposure of the heater resistor and its electrical interconnections to the ink will result in a chemical attack upon the heater resistor and electrical conductors. A hard non-conductive passivation layer is disposed over the heater resistor to provide this protection from the ink. The cavitation layer and the passivation layer can be thought of, in concert, as a protective layer. Significant effort has been expended in the past to protect the heater resistor from cavitation and attack, including the separating of the heater resistor into several parts and leaving a center zone (upon which a majority of the cavitation energy concentrates in a top firing thermal inkjet firing chamber) free of resistive material.

Significant effort is also expended in improving print quality. Print quality has become one of the most important considerations of competition in the color inkjet printer field. Since the image output of a color inkjet printer is formed of individual ink drops, the quality and fidelity of the image is ultimately dependent upon the quality of each ink drop and its placement and arrangement as a dot on the printed medium.

One source of reduced print quality is improper ink drop volume. It is known that drop volumes vary with the printhead substrate temperature because the properties that control it vary with temperature: the viscosity of the ink itself and the amount of ink vaporized by a heater resistor when driven by a given electrical printing pulse. Changes in drop volume also cause variations in the darkness of black text, variations in the contrast of gray-scale images, as well as variations in the chroma, hue, and lightness of color images. In a printing system that employs a limited number of color inks, the chroma, hue, and lightness of a printed color depends upon the volume of all the primary color drops that create the printed color. If the printhead substrate temperature increases or decreases as a page of media is printed, the colors at the top of the page can differ from the colors at the bottom of the page. Additionally, when at room temperature, a thermal inkjet printhead must eject drops of sufficient size to form satisfactory printed text or graphics. However, printheads that meet this performance requirement can eject drops containing excessive amounts of ink when the printhead substrate is warm. Excessive ink degrades print quality by causing feathering of the ink dots, bleeding of the dots having different colors, and cockle and curling of the medium. In addition, different print media, i.e., plain paper, special paper, or transparency material requires different ink drop volumes for optimum performance. Controlling the ink drop volume depending upon the above conditions helps to eliminate these problems and improve print quality.

Generally, the drop volume from an inkjet printer printhead can be adjusted by varying the drop generator physical geometry (changing the heater resistor size and nozzle orifice size), varying the ink refill speed (changing the backpressure, ink filter fluid resistance, and ink feed channel restrictions), varying the size and strength of the vaporization bubble (adjusting ink temperature, nucleation surface heating rate, and nucleation surface roughness and cleanliness), and varying fluidic response such as ink viscosity (which is also a function of ink temperature). A related method of adjusting drop volume is that of ejecting multiple smaller droplets to deposit neighboring or overlapping dots on the printed medium. The foregoing factors can be divided into two categories: factors that can be dynamically changed by operation of the printer and factors that are fixed design parameters. Of the above factors, only temperature, nucleation surface heating rate, and multiple droplet expulsion can be dynamically adjusted by the printer.

Printhead temperature control has been discussed in, for example, U.S. Pat. No. 5,673,069 "Method and Apparatus for Reducing the Size of Drops Ejected from a Thermal Ink Jet Printhead". Variation in the electrical pulse width supplied to the heater resistor, thereby affecting nucleation surface heating rate, will produce a variable drop volume proportional to the pulse width. U.S. Pat. No. 5,726,690, "Control of Ink Drop Volume in Thermal Inkjet Printheads by Varying the Pulse Width of the Firing Pulses" discloses a method for doing so. Others have shown that printheads could be constructed with a protective layer having a thickness gradient. See U.S. Pat. No. 4,339,762, "Liquid Jet Recording Method". This gradient provides a positional variation in the point of bubble nucleation relative to the applied electric potential. When utilized in a system that ejects ink drops parallel to the plane of the heater resistor, the volume of the drop of ink can be made a function of the location of nucleation on the heater resistor and therefore a function of the applied electric potential. Multiple droplet deposition, such as that described in U.S. Pat. Nos. 4,967,203, "Interlace Printing Process "; U.S. Pat. No. 4,999,646, "Method for Enhancing the Uniformity and Consistency of Dot Formation Produced by Color Ink Jet Printing"; and U.S. Pat. No. 5,583,550, "Ink Drop Placement for Improved Imaging", have the disadvantage of decreasing the throughput of the printer.

The efforts of others notwithstanding, a variable drop mass having good control of ejected drop direction in a thermal inkjet printer printhead has not been readily achieved. It is highly desirable, at least for reasons of alphanumeric character quality and color image fidelity, that a dynamic selection of ink drop mass be made available for an inkjet printer without excessive cost, reduction in throughput, or degraded directionality of drop ejection.

SUMMARY OF THE INVENTION

An inkjet printing apparatus and its methods of manufacture and use encompass an apparatus that ejects ink drops onto a print medium. A thin film resistor is disposed on a substrate and further comprises a thin film resistor segmented into three segments. Two of these three segments have a variable drop weight versus applied energy characteristic and the third segment is disposed adjacent and between the two segments. The three segments are electrically coupled together. A protective layer is disposed at least on the thin film resistor. An orifice plate has a nozzle disposed in correspondence with the thin film resistor such that ink is expelled from the nozzle when the thin film resistor is electrically energized.

DESCRIPTION OF THE PREFERRED EMBODIMENTS

Figure 1:
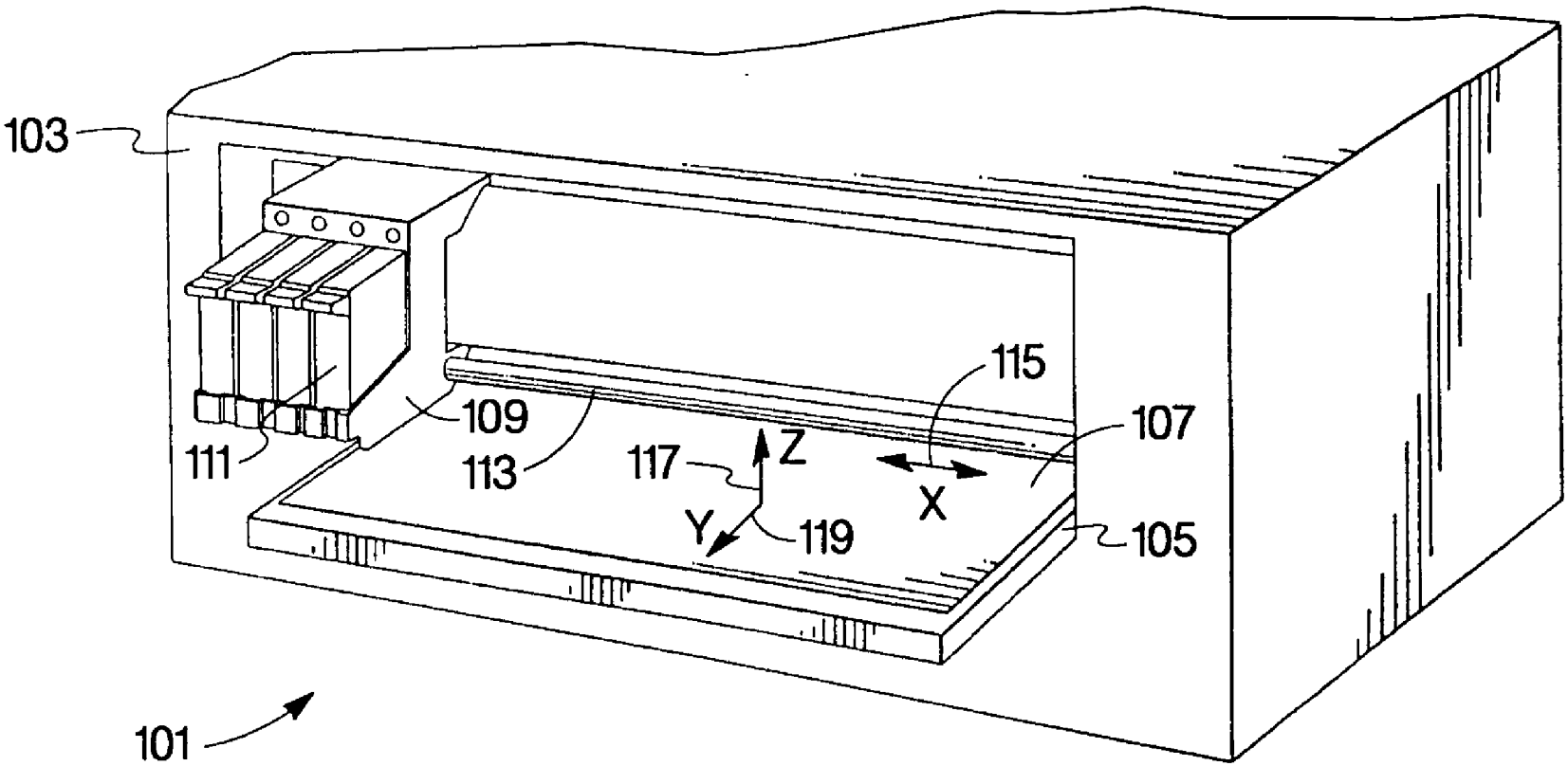
FIG. 1 is an illustration in perspective view (partial cut-away) of an illustrative inkjet printer apparatus (cover panel facia removed) in which the present invention may be incorporated.

An inkjet printing apparatus can achieve higher print quality and improved color image fidelity when a dynamically controlled ink drop mass can be ejected from the printhead. An exemplary inkjet printer 101 which may realize this goal, is shown in rudimentary form in FIG. 1. A printer housing 103 contains a platen 105 to which input print media 107 is transported by mechanisms which are known in the art. A carriage 109 holds a set of individual print cartridges, e.g. 111, one having cyan ink, one having magenta ink, one having yellow ink, and one having black ink. Alternative embodiments can include semi-permanent printhead mechanisms having at least one small volume, onboard, ink chamber that is sporadically replenished from fluidically-coupled, off-axis, ink reservoirs or print cartridges having two or more colors of ink available within the print cartridge and ink ejecting nozzles specifically designated for each color; the present invention is applicable to inkjet cartridges of any of the alternatives. The carriage 109 is typically mounted on a slide bar 113 or similar mechanism, allowing the carriage 109 to be reciprocated or scanned back and forth across the print media 107. The scan axis, X, is indicated by arrow 115. As the carriage 109 scans, ink drops are selectively ejected from the set of print cartridges onto the media 107 in predetermined print swath patterns, forming images or alphanumeric characters using dot matrix manipulation. Generally, the dot matrix manipulation is determined by a computer (not shown) and instructions are transmitted to a microprocessor-based, electronic controller (not shown) within the printer 101. The ink drop trajectory axis, Z, is indicated by arrow 117. When a swath of print has been completed, the media 107 is moved an appropriate distance along the print media axis, Y, indicated by arrow 119 in preparation for the printing of the next swath.

Figure 2:
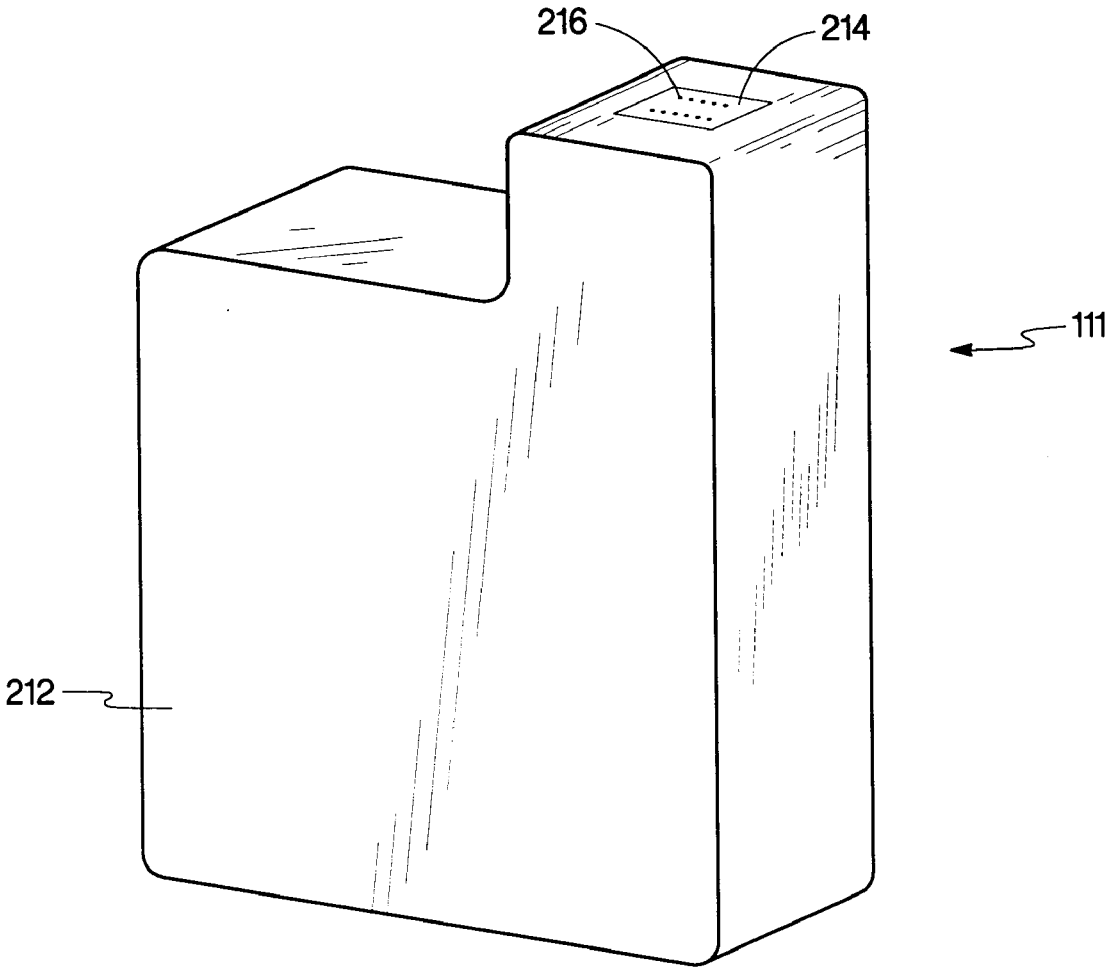
FIG. 2 is an isometric illustration of an inkjet print cartridge useable in the printer apparatus of FIG. 1.

An exemplary thermal inkjet cartridge 111 is shown in FIG. 2. A cartridge housing, or shell, 212 contains an internal reservoir of ink (not shown). The cartridge 111 is provided with a printhead 214 that includes a foraminous orifice plate 216 having a plurality of miniature nozzles constructed in combination with subjacent firing chambers and structures leading to respective ink ejectors, and electrical contacts for coupling to the printer 101. A single ink drop generator is illustrated in the magnified isometric cross section of FIG. 3. As depicted, the drop generator comprises a nozzle, a firing chamber, and an ink ejector. Alternative embodiments of a drop generator employ more than one coordinated nozzle, firing chamber, and/or ink ejectors.

Figure 3:
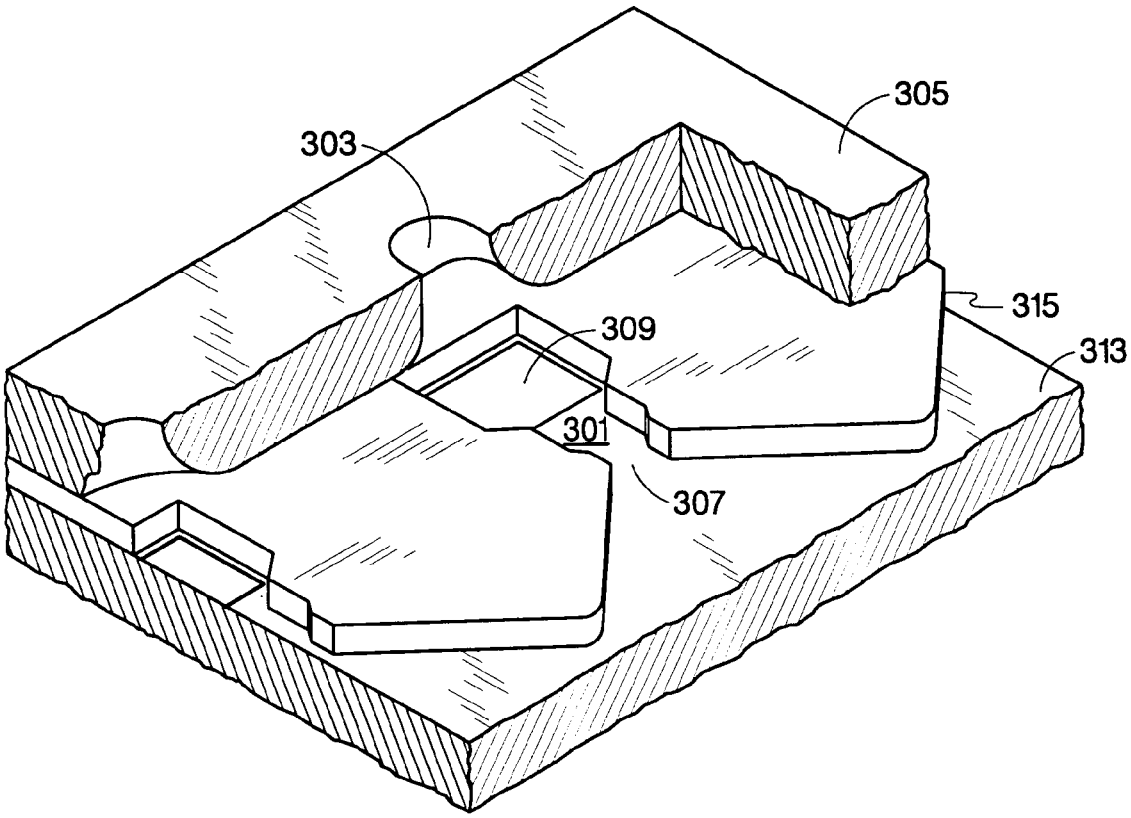
FIG. 3 is a magnified isometric cross section of a drop generator element of the printhead component of FIG. 2.

The ink ejector and associated ink feed channels of printhead 214 is shown in the magnified isometric cross sectional view of a drop generator in FIG. 3. An ink firing chamber 301 is shown in correspondence with a nozzle 303 in a preferred embodiment. Part of a second nozzle, associated with another ink firing chamber is also shown. Many independent nozzles are typically arranged in a predetermined pattern on the orifice plate so that the ink which is expelled from selected nozzles creates a defined character or image of print on the medium. Generally, the medium is maintained in a position which is parallel to the external surface of the orifice plate. The heater resistors are selected for activation by a microprocessor and associated circuitry in the printer in a pattern related to the data entered to the printer so that ink which is expelled from selected nozzles created a defined character or image of print on the medium. Ink is supplied to the firing chamber 301 via opening 307 to replenish ink that has been expelled from orifice 303 when ink has been vaporized by localized heating from a heater resistor 309. The ink firing chamber is bounded by walls created by an orifice plate 305, a layered semiconductor substrate 313, and firing chamber wall 315. In a preferred embodiment, fluid ink stored in a reservoir of the cartridge housing 212 flows by capillary force to fill the firing chamber 301.

Once the ink is in the firing chamber 301 it remains there until it is rapidly vaporized by the heat energy created by an electrically energized heater resistor 309. Conventionally, the heater resistor 309 is a planar thin film resistance structure disposed on the surface of substrate 313 with one of its planar surfaces in contact with a surface of the substrate. The other of the heater resistor planar surfaces is in contact with a passivation layer and overlain by a cavitation layer. Electrical contact to the heater resistor is made by electrical conductors. The substrate is typically a semiconductor such as silicon. The silicon is treated using either thermal oxidation or vapor deposition techniques to form a thin layer of silicon dioxide thereon. The heater resistor 309 is created by depositing a film of resistive material on the silicon dioxide. Preferably, the film is tantalum aluminum, TaAl, which is a well known resistive heater material in the art of thermal inkjet printhead construction. Next, a thin layer of aluminum is deposited to provide the electrical conductors.

In the particular materials set described above for a preferred embodiment of the invention, the silicon-silicon dioxide combination is approximately 600 microns in thickness; the tantalum aluminum layer is approximately 1000 angstroms in thickness; and the aluminum layer is approximately 5000 angstroms in thickness. The resistor and conductor materials are conventionally magnetron sputter deposited. A pattern is etched in the aluminum layer to form the opening which defines the lateral extent of the heater resistor element that is current driven by the conductive trace aluminum layer. Then, in the preferred embodiment, a composite layer barrier material is deposited over the upper surface of the structure and includes a first layer of silicon nitride which is covered by a second layer of highly inert silicon carbide. This composite layer passivation material provides both good adherence to the underlying materials and good insulation and protection against cavitation wear and ink corrosion which the underlying layers beneath these materials would otherwise receive during an ink jet printing operation. An area over the heater resistor 309 and its associated electrical connection to electrical conductors is masked and a cavitation layer of tantalum 4000 Angstroms thick is conventionally sputter deposited.

In a preferred embodiment, the sides of the firing chamber 301 and the ink feed channel are defined by a polymer barrier layer 315. This barrier layer is preferably made of an organic polymer plastic that is substantially inert to the corrosive action of ink and is conventionally deposited upon substrate 313 and its various protective layers and is subsequently photolithographically defined into desired shapes and then etched. Typically the barrier layer 315 has a thickness of about 25 to 30 micrometers after the printhead is assembled with the orifice plate 305. The orifice plate 305 is secured to the substrate 313 by the barrier layer 315. Typically the orifice plate 305 is constructed of nickel with plating of gold to resist the corrosive effects of the ink. In an alternative embodiment, the orifice plate is formed on the substrate and some of the deposited thin film layers thereon. It is preferably formed using a spin-on or laminated polymer such as polyamide, polymethylmethacrylate, polycarbonate, polyester, polyethyleneterephthalate, polyamide, or mixtures thereof Nozzle configuration is a design factor that controls droplet size, velocity, and trajectory of the droplets of ink in the Z-axis (toward the medium to be printed upon). The nozzles are arranged in a predetermined association with the ink ejectors (heater resistors, in a thermal inkjet printhead). This association is usually with the center axis of the nozzle perpendicular to the plane of the heater resistor and coincident with the center point of the heater resistor. Placing nozzle orifices close together presents a problem in the designing of ink ejectors and the electrical connections which must be made to them. These electrical interconnections are typically thin film metalized conductors that electrically connect the ink ejectors on the printhead to contact pads, thence to printhead interface circuitry in the printer. A technique commonly known as "integrated drive head" or IDH multiplexing is conventionally used to reduce electrical interconnections between a printer and its associated print cartridges. Examples of IDH multiplexing may be found in U.S. Pat. No. 5,541,629 "Printhead with Reduced Interconnections to a Printer". In an IDH design, the ink ejectors (heater resistors) are divided into groups known as primitives. Each primitive has its own power supply interconnection ("primitive select") and return interconnection ("primitive return" or "primitive common"). In addition, a number of control lines ("address lines") are used to enable particular heater resistors. These address lines are shared among all primitives. The energizing of each heater resistor is controlled by activation of a primitive select and by a transistor such as a MOSFET that acts as a switch connected in series with each resistor. By applying a voltage across one or more primitive selects (PS1, PS2, etc. in FIG. 4) and the primitive return, and activating the associated gate of a selected transistor, multiple independently addressed heater resistors may be fired simultaneously.

Figure 4:
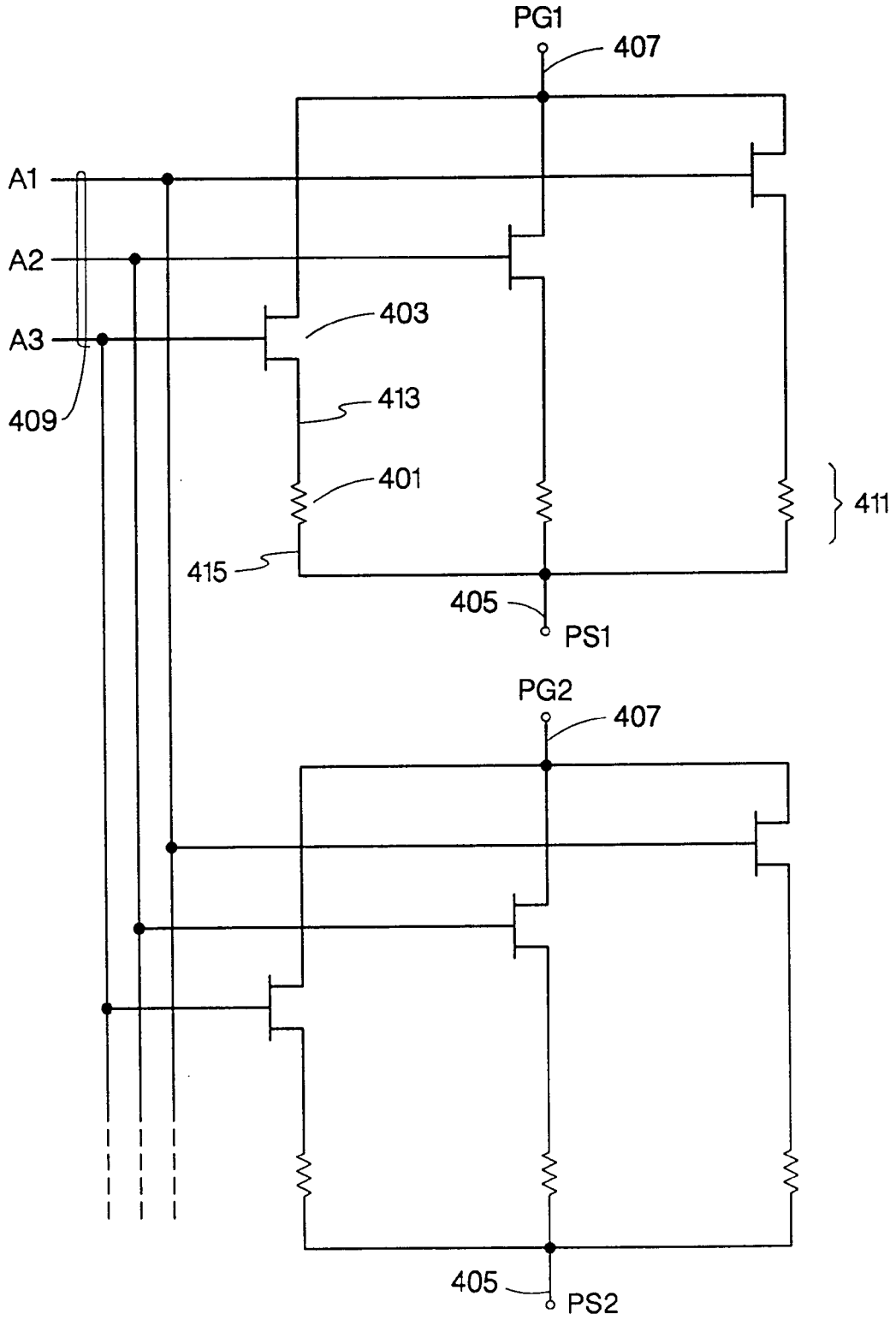
FIG. 4 is an electrical schematic that illustrates a typical heater resistor IDH circuitry for the printhead of FIG. 2.

FIG. 4 is an electrical schematic that illustrates a typical ink ejector IDH matrix circuitry on the printhead. This configuration enables the selection of which ink ejectors to fire in response to print commands from the printer. The ink ejectors are arranged in correspondence with the nozzle orifices and are identified in the electrical matrix by enable signals within a print command directed to the printhead by the printer. Each ink ejector generally comprises a heater resistor (for example, resistor 401) and a switching device (for example, transistor 403). Common electrical connections include a primitive select (PS(n)) lead 405, a primitive common (PG(n)) lead 407, and address interconnections 409. Each switching device (e.g. 403) is connected in series with each heater resistor (e.g. 401) between the primitive select 405 and primitive common 407 leads. The address interconnections 409 (e.g. address A3) are connected to the control port of the switch device (e.g. 403) for switching the device between a conductive state and a nonconductive state. In the conductive state, the switch device 403 completes a circuit from the primitive common lead 407 through the heater resistor 401 to the primitive select lead 407 to energize the heater resistor when primitive select PS1 is coupled to a source of electrical power.

Each row of ink ejectors in the matrix is deemed a primitive and may be selectively prepared for firing by powering the associated primitive select lead 405, for example PS1 for the row of heater resistors designated 411 in FIG. 4. While only three heater resistors are shown here, it should be understood that any number of heater resistors can be included in a primitive, consistent with the objectives of the designer and the limitations imposed by other printer and printhead constraints. Likewise, the number of primitives is a design choice of the designer. To provide uniform energy for the heater resistors of the primitive, it is preferred that only one series switch device per primitive be energized at a time. However, any number of the primitive selects may be enabled concurrently. Each enabled primitive select, such as PS1 or PS2, thus delivers both power and one of the enable signals to the ink ejector. One other enable signal for the matrix is an address signal provided by each control interconnection 409, such as A1, A2, etc., only one of which is preferably active at a time. Each address interconnection 409 is coupled to all of the switch devices in a matrix column so that all such switch devices in the column are conductive when the interconnection is enabled or "active," ie. at a voltage level which turns on the switch devices. Where a primitive select and an address interconnection for a heater resistor R are both active concurrently, that resistor is electrically energized, rapidly heats, and vaporizes ink in the associated ink firing chamber.

Figure 5A:
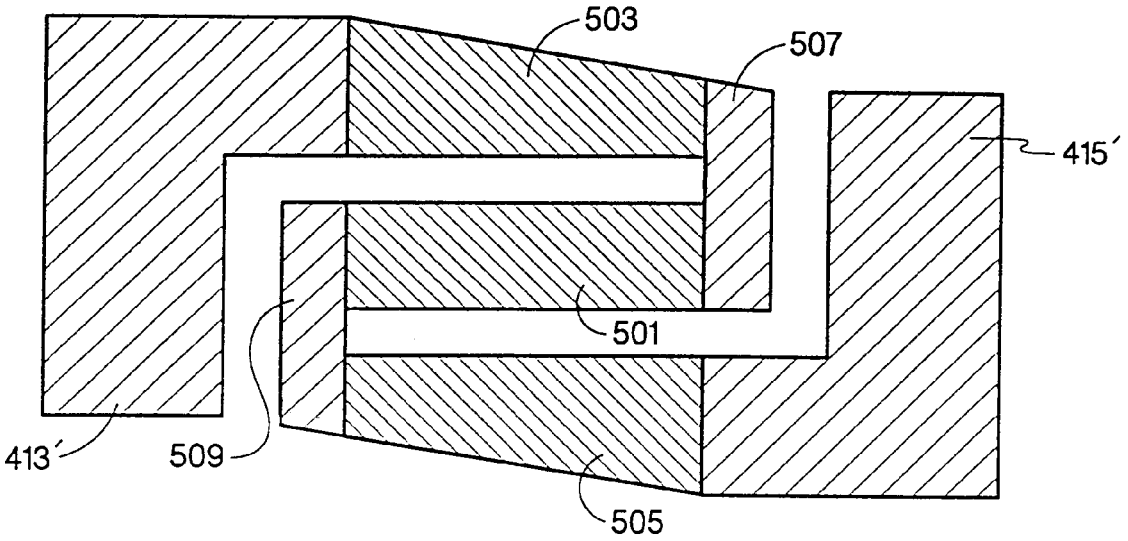
FIGS. 5A, 5B, 5C, and 5D are plan views of a multi-segment heater resistor which may employ the present invention and which illustrate nucleation at different applied energies.

A top plan view of a heater resistor and its associated conductors are shown in FIG. 5A. The heater resistor shown provides additional detail over the generalized heater resistor 309 of FIG. 3. The orifice plate that contains the nozzle and any other firing chamber structures have been deleted for clarity here. In a preferred embodiment, the heater resistor is realized as a thin film planar structure having three resistive areas connected in series: a center resistive segment 501 and two side resistive segments 503 and 505. The electrical conductors leading to heater resistor 501 are realized as thin film metallic conductors 413' and 415' electrically and physically connected to the heater resistor on opposite sides of the resistor. When voltage is applied across the heater resistor via conductors'413' and 415', electric current flows from conductor, for example conductor 413' disposed on one side of the heater resistor, into resistive segment 503 then into conductor 507. Conductor 507 is electrically connected to resistive segment 501 so electric current flows into the center resistive segment 501 then to conductor 509 to resistive segment 505 and conductor 415'. Upon the voltage being connected across the conductors, current flows through the multi-segmented heater resistor for the duration of the connection resulting in energy being dissipated by the heater resistor as heat. It is desired that a majority of the heat be quickly transferred to the ink that is contained in the firing chamber and that an ink ejecting ink vapor bubble be formed to eject a volume of ink. It is a feature of the present invention that the heater resistor be arranged as a multi-segmented resistor. In the preferred embodiment, each segment is electrically connected in series to allow a higher voltage to be used rather than a parallel connection. However, if the design of the printhead will tolerate the higher current of a parallel segmented resistor, the present invention may be accomplished using such a parallel connection as illustrated in FIG. 5D. In either implementation, it is important that the center resistive segment be physically located substantially between the other side resistive segments. Such an arrangement provides a reduction in thermal loss of the center resistive segment thereby causing this segment to become hotter. Additionally, the width of the center resistive segment may be reduced relative to the side resistive segments to further assure that the center resistive segment is the hottest of the segments, or a surface feature creating a preferred point of higher thermal energy may be used to ensure nucleation occurs first at the surface feature.

Figure 5B:
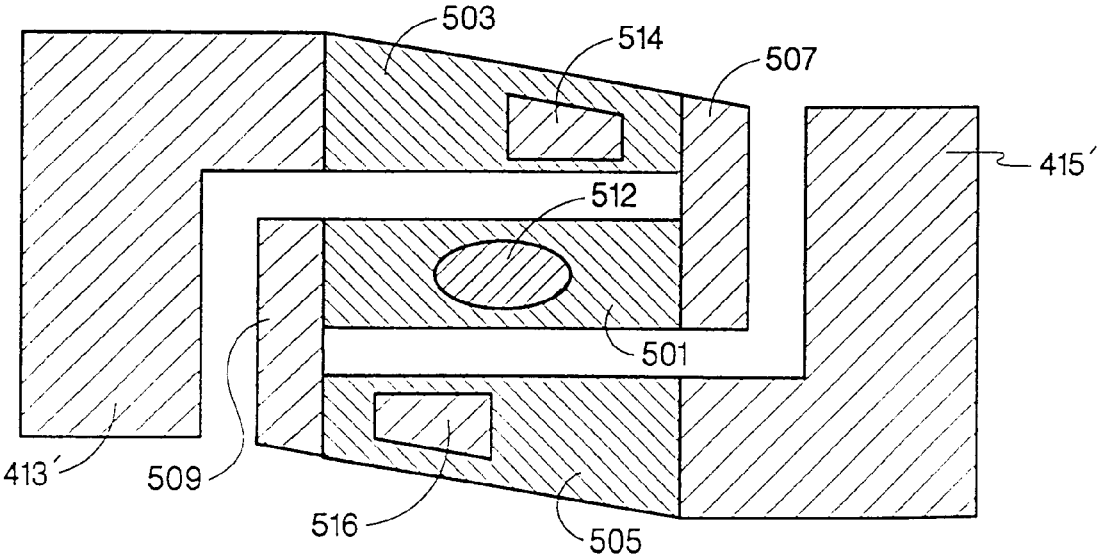

Referring now to FIG. 5B, an illustration of the ink vapor bubble nucleation zone 512 of a preferred embodiment is shown located over the center resistive segment 501. Since the center resistive segment 501 is assured of being the hottest of the segments by its physical location between the remaining segments and by having the smallest thin film area, the center resistive segment reliably forms the vapor bubble.

In a preferred embodiment, the side resistive segments are formed as trapezoidal areas and arranged with one edge of the trapezoidal area disposed parallel to an edge of the center resistive segment. Thus, in a three segment heater resistor, side segment 503 and side segment 505 are formed as trapezoidal areas, each with an edge disposed parallel to an edge of center resistive segment 501. It has been shown elsewhere that a trapezoidal thin film heater resistor will create a variable sized vapor bubble depending upon the amount of energy dissipated by the heater resistor. Moreover, the positional center of nucleation moves from the apex of the trapezoid to the base of the trapezoid with increasing applied energy. The three segment resistor of FIG. 5B, then, nucleates an ink vapor bubble first at zone 512 and then at zones 514 and 516 at segments 503 and 505, respectively, with a first energy magnitude $E_1$. As the vapor bubbles expand from their points of nucleation and coalesce, a rotational momentum is imparted to the bubble approximately centered over zone 512.

Figure 5C:
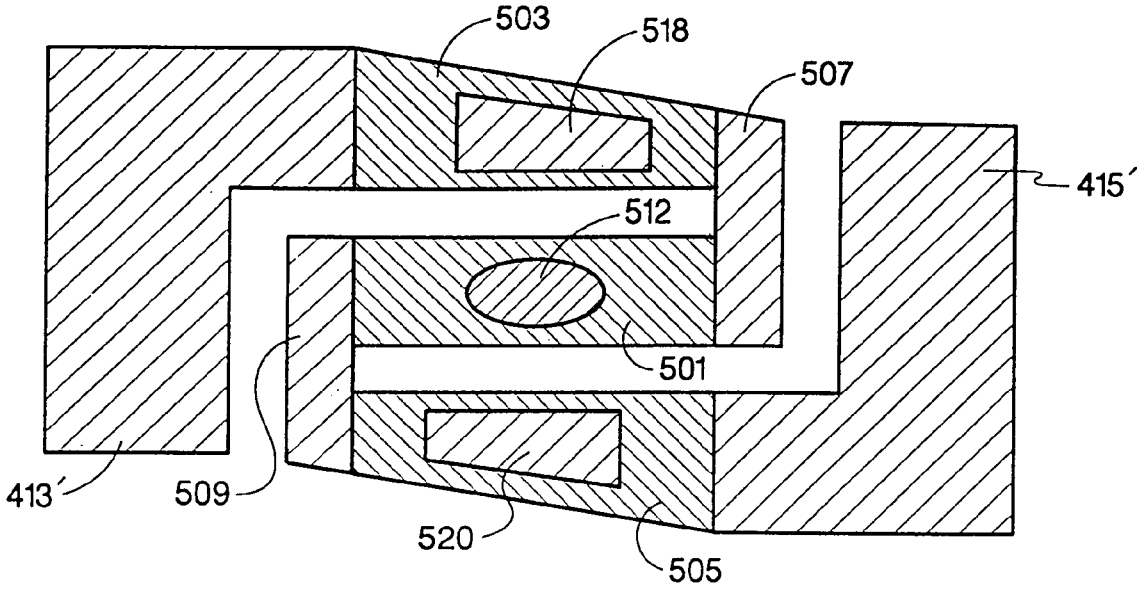
Figure 6:
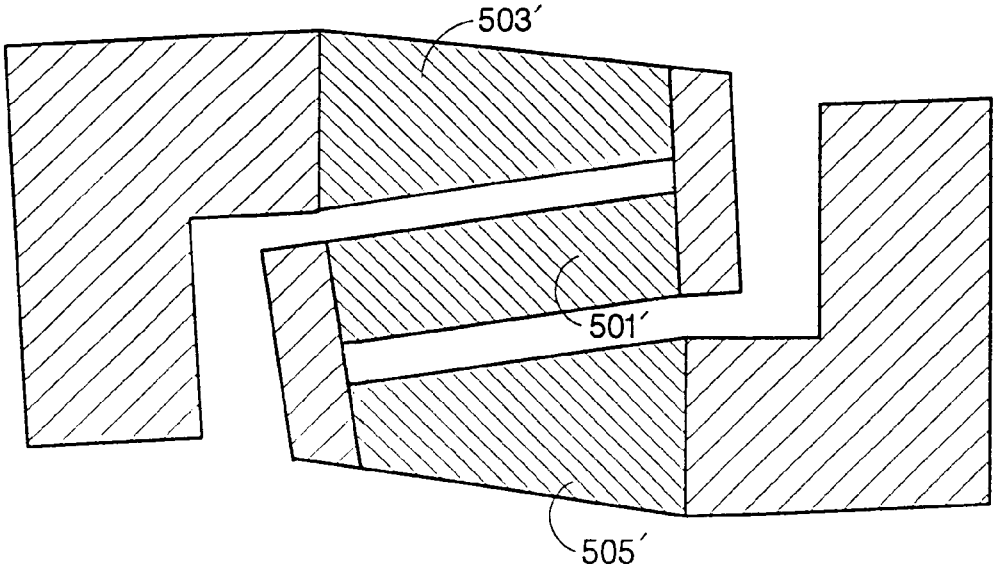
FIG. 6 is a plan view of an alternative embodiment of a multi-segment heater which may employ the present invention.
Figure 5D:
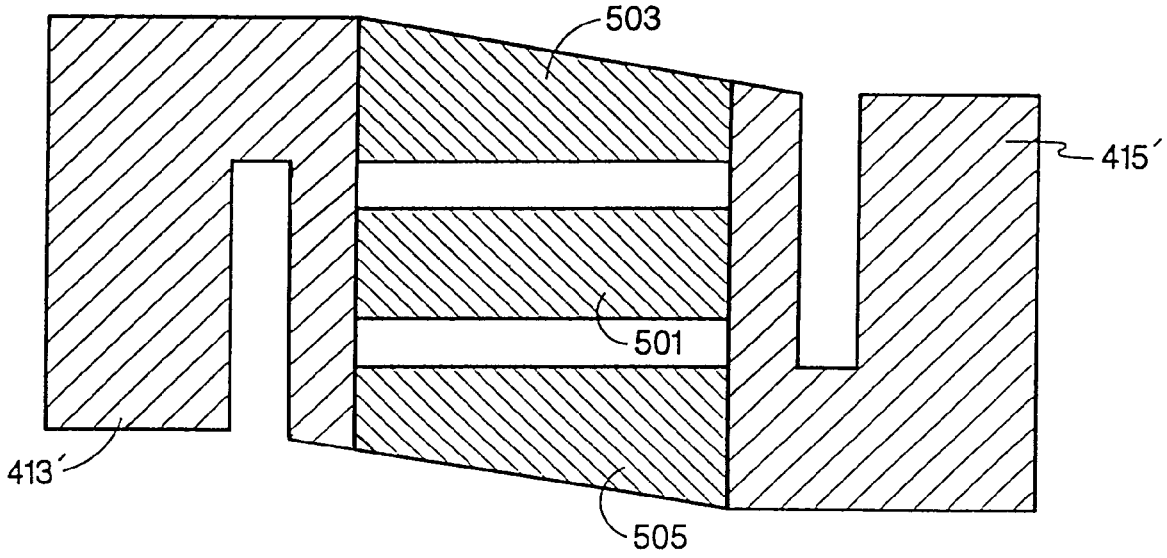

When a larger energy magnitude, $E_2$, is applied to the segmented heater resistor, the areas of nucleation over the trapezoidal segments increase and move toward the base of the thin film trapezoidal segment. This can be appreciated from the illustration of FIG. 5C. The larger energy causes a larger vapor bubble to be formed over the expanded nucleation areas 518 and 520 over side resistive segments 503 and 505, respectively. A larger vapor bubble is formed as a sum of the bubble from the three sites and, as a consequence, a larger mass of ink is expelled from the nozzle when energy $E_2$ is applied than when energy $E_1$ is applied. However, the vapor bubble formed with the larger magnitude of energy, $E_2$, continues to be formed with its center at the zone 512 of center resistive segment 501 and rotational momentum about this center. In this way, the vapor bubble reliably forms about the same nucleation point and will produce an ejected ink drop with fewer directional errors than with other variable drop mass generation techniques (for example, a single trapezoidal area heater resistor). An alternative embodiment of a dual trapezoidal area side resistive segmented heater resistor (with side segments 503' and 505') having an edge parallel to the edges of a center resistive segment (501') is shown in FIG. 6.

In accordance with the foregoing, an inkjet printing apparatus utilizes a mechanism for dynamically generating ink drops with a variable drop mass and with a repeatable nucleation site for improved drop ejection direction control so that print quality and color image fidelity can be improved.

I claim:

1. A thermal inkjet printing apparatus that ejects ink drops onto a print medium, comprising:

a substrate;

a thin film resistor disposed on said substrate, said thin film resistor further comprising three segments, two of said three segments having a variable drop mass versus applied energy characteristic and said two segments further comprising a segment having a trapezoidal geometric shape and said third segment having a rectangular geometric shape and disposed adjacent and between said two trapezoidal shaped segments, each said two trapezoidally shaped segments including two parallel sides and two non-parallel sides, one of said non-parallel sides of each of said two trapezoidally shaped segments being disposed adjacent and parallel to a respective long side of said rectangular shaped third segment, said three segments being electrically coupled together;

a protective layer disposed at least on said thin film resistor; and an orifice plate having a nozzle disposed in correspondence with said thin film resistor such that ink is expelled from said nozzle when said thin film resistor is electrically energized.

2. A thermal inkjet printing apparatus in accordance with claim 1 wherein each of said two trapezoidally shaped segments further comprises said trapezoidal geometric shape of two parallel sides of unequal length and two non-parallel sides, one of said non-parallel sides being disposed perpendicular to said two parallel sides.

3. A thermal inkjet printing apparatus in accordance with claim 1 wherein said three segments are electrically coupled together in series.

4. A thermal inkjet printing apparatus in accordance with claim 1 wherein said three segments are electrically coupled together in parallel.

5. A method of ejecting ink drops onto a print medium comprising the steps of:

applying a first magnitude of electrical energy to a segmented thin film resistor disposed on a substrate;

in response to said applying said first magnitude of energy, heating two segments of said segmented thin film resistor to create two ink vapor bubbles of a first volume;

in response to said applying said first magnitude of energy, heating a third segment of said segmented thin film resistor to create an ink vapor bubble of a second volume, whereby when said two first volume ink vapor bubbles and said second volume ink vapor bubble coalesce, an ink drop of a first mass is ejected;

applying a second magnitude of electrical energy to said segmented thin film resistor;

in response to said applying said second magnitude of energy, heating two segments of said segmented thin film resistor to create two ink vapor bubbles of a third volume; and in response to said applying said second magnitude of energy, heating said third segment of said segmented thin film resistor to create said ink vapor bubble of said second volume, whereby when said two third volume ink vapor bubbles and said second volume ink vapor bubble coalesce, an ink drop of a second mass is ejected.

6. A method of manufacturing a thermal inkjet printing apparatus that ejects ink drops onto a print medium comprising the steps of:

disposing a thin film resistor on a substrate and segmenting said thin film resistor into three segments;

providing said two of said three segments each with a trapezoidal geometric shape thereby yielding a variable drop weight versus applied energy characteristic, each of said two trapezoidally shaped segments including two parallel sides and two non-parallel sides;

providing said third segment of said three segments with a rectangular geometric shape;

disposing said third segment adjacent and between said two trapezoidal shaped segments such that each respective long side of said rectangularly shaped third segment is arranged adjacent and parallel to a respective one of said non-parallel sides of each of said two trapezoidally shaped segments;

electrically coupling said three segments together;

disposing a protective layer at least on said thin film resistor; and disposing an orifice plate having a nozzle in fluid correspondence with said thin film resistor such that ink is expelled from said nozzle when said thin film resistor is electrically energized.

7. A method in accordance with the method of claim 6 further comprising the step of providing each of said two trapezoidally shaped segments a trapezoidal geometric shape of two parallel sides of unequal length and two non-parallel sides, one of said non-parallel sides being disposed perpendicular to said two parallel sides.

8. A method in accordance with the method of claim 6 wherein said step of coupling said three segments together further comprises the step of coupling said three segments together in series.

9. A method in accordance with the method of claim 6 wherein said step of coupling said three segments together further comprises the step of coupling said three segments together in parallel.

10. A thermal inkjet printing apparatus that ejects ink drops onto a print medium, comprising:

a substrate;

a thin film resistor disposed on said substrate and comprising a plurality of electrically coupled segments, a first segment of said plurality of segments having an area of preferred ink vapor bubble nucleation, and at least second and third segments of said plurality of segments producing an ink drop mass which varies with applied energy, wherein said second and third of said three segments each further comprise a segment having a trapezoidal geometric shape and said first segment further comprises a segment having a rectangular geometric shape and disposed adjacent and between said second and third trapezoidal shaped segments, each said second and third trapezoidally shaped segments including two parallel sides and two non-parallel sides, one of said non-parallel sides of each of said second and third trapezoidally shaped segments being disposed adjacent and parallel to a respective long side of said rectangular shaped first segment; and an orifice plate having a nozzle disposed therein in correspondence with said thin film resistor such that an ink drop having said drop mass that varies is ejected with reliable directional momentum from said nozzle when said thin film resistor is electrically energized.

11. A thermal inkjet printing apparatus in accordance with claim 10 wherein said first segment is at least partially surrounded by at least said second and third segments.

12. A thermal inkjet printing apparatus in accordance with claim 10 wherein each of said two trapezoidally shaped segments further comprises a trapezoidal geometric shape of two parallel sides of unequal length and two non-parallel sides, one of said non-parallel sides being disposed perpendicular to said two parallel sides.

13. A thermal inkjet printing apparatus in accordance with claim 10 wherein said three segments are electrically coupled together in series.

14. A thermal inkjet printing apparatus in accordance with claim 10 wherein said three segments are electrically coupled together in parallel.

* * * * *